US010752463B2

(12) United States Patent
Stech et al.

(10) Patent No.: US 10,752,463 B2
(45) Date of Patent: Aug. 25, 2020

(54) CHANGING ELEMENT FOR A SPINNING MACHINE, AND SPINNING MACHINE EQUIPPED WITH SAID CHANGING ELEMENT

(71) Applicant: Maschinenfabrik Rieter AG, Winterthur (CH)

(72) Inventors: Jiri Stech, Usti nad Orlici (CZ); Petr Haska, Ceska Trevova (CZ)

(73) Assignee: MASCHINEFABRIK RIETER AG, Winterthur (CH)

( * ) Notice: Subject to any disclaimer, the term of this patent is extended or adjusted under 35 U.S.C. 154(b) by 800 days.

(21) Appl. No.: 15/313,464

(22) PCT Filed: May 11, 2015

(86) PCT No.: PCT/IB2015/000660

§ 371 (c)(1),
(2) Date: Nov. 22, 2016

(87) PCT Pub. No.: WO2015/181599

PCT Pub. Date: Dec. 3, 2015

(65) Prior Publication Data

US 2017/0096316 A1 Apr. 6, 2017

(30) Foreign Application Priority Data

May 27, 2014 (CH) ..... 806/14

(51) Int. Cl.
*B65H 57/00* (2006.01)
*D01H 13/06* (2006.01)
(Continued)

(52) U.S. Cl.
CPC ..... *B65H 57/006* (2013.01); *D01H 1/16* (2013.01); *D01H 13/06* (2013.01);
(Continued)

(58) Field of Classification Search
CPC ..... B65H 7/006; D01H 1/16; D01H 13/06
See application file for complete search history.

(56) References Cited

U.S. PATENT DOCUMENTS 3,762,141 A * 10/1973 Slack ..... D01D 5/423 57/31
3,866,404 A 2/1975 Doleman
(Continued)

FOREIGN PATENT DOCUMENTS

DE 44 28 177 A1 3/1994
DE 101 33 837 A1 1/2003
(Continued)

OTHER PUBLICATIONS

Swiss Patent Office Search Report, dated Oct. 10, 2014.
PCT Search Report, dated Sep. 15, 2015.

*Primary Examiner* — Shaun R Hurley
(74) *Attorney, Agent, or Firm* — Dority & Manning, P.A.

(57) ABSTRACT

A traversing element is provided for a spinning machine that produces a roving. The traversing element includes a guide segment disposed to guide the roving onto a surface of a tube or a roving bobbin, and a support segment. The guide segment is configured at an end of the support segment and an opposite end of the support segment is connectable to a support of the spinning machine. A closed cavity is provided in the traversing element, the closed cavity partially filled with a liquid. Heat that occurs in the guide segment due to friction between the guide segment and the roving when the traversing element is operating is absorbed by the liquid.

11 Claims, 5 Drawing Sheets

(51) Int. Cl.
*D01H 1/16* (2006.01)
*D01H 1/115* (2006.01)

(52) U.S. Cl.
CPC ..... *B65H 2301/5144* (2013.01); *B65H 2701/311* (2013.01); *D01H 1/115* (2013.01)

(56) References Cited

U.S. PATENT DOCUMENTS

| | | | | |
|---|---|---|---|---|
| 4,334,402 | A * | 6/1982 | Stutz | D01H 7/62 57/120 |
| 4,976,098 | A | 12/1990 | Meyer et al. | |
| 6,571,547 | B2 * | 6/2003 | Llongueras | D01H 7/62 57/120 |
| 2002/0021101 | A1 | 2/2002 | Trimborn et al. | |
| 2002/0194707 | A1 * | 12/2002 | Strobel | F16C 13/00 19/236 |

FOREIGN PATENT DOCUMENTS

| | | | |
|---|---|---|---|
| DE | 10 2005 015747 | A1 | 10/2006 |
| EP | 0 326 688 | A1 | 8/1989 |
| EP | 0 857 682 | A2 | 8/1998 |
| EP | 1 184 321 | A2 | 3/2002 |

* cited by examiner

CHANGING ELEMENT FOR A SPINNING MACHINE, AND SPINNING MACHINE EQUIPPED WITH SAID CHANGING ELEMENT

FIELD OF THE INVENTION

The present invention relates to a traversing element for a spinning machine that serves for producing roving, wherein the traversing element comprises a guide segment by means of which the roving may be guided in the region of a surface of a tube or of a roving bobbin, and wherein the traversing element includes a support segment via which it may be connected to a support beam of the spinning machine. Furthermore, is a spinning machine is suggested having at least one spinning nozzle by means of which roving may be produced from a fiber bundle supplied to the spinning nozzle, wherein the spinning machine has a winding device for winding the roving produced by the spinning nozzle.

BACKGROUND

Generic traversing elements are known in the context of spinning machines and are used to guide the roving produced by the spinning station while it is being wound onto a tube. In principle, the traversing element is moved back and forth between two end points on a path running parallel to the rotation axis of the tube so that the roving finally travels onto the tube in the form of layers of roving overlaying one another and the desired roving bobbin is created (in the context of the invention, the term "roving bobbin" shall be construed to be a tube with roving wound thereon).

Conventional traversing elements consist primarily of metal elements that heat up with friction due to the contact with the roving moving past it on the corresponding guide segment of the traversing element, which can have a negative effect on the roving properties.

SUMMARY

An object of the present invention is therefore to suggest a traversing element and a spinning machine equipped therewith which counteract this problem. Additional objects and advantages of the invention will be set forth in part in the following description, or may be obvious from the description, or may be learned through practice of the invention.

The objects are attained by a traversing element and a spinning machine having the features described and claimed herein.

In general it should be clarified at this point that the roving produced by the spinning machine and guided by the traversing element is essentially a fiber bundle having an outer portion of the fibers (so-called wrapping fibers) wound about an inner, preferably untwisted portion of the fibers in order to provide the roving with the desired strength. In addition, roving has a relatively small portion of wrapping fibers, wherein the wrapping fibers are wound relatively loosely about the inner (preferably untwisted) core so that the roving remains draftable. This is important if the produced roving is to be or must be drafted again on a downstream textile machine (for instance a ring spinning machine) by means of a drafting system in order to be able to be further processed into a weavable yarn.

According to the invention, the traversing element is characterized in that it has at least one cavity that is closed to the outside and is partially filled with a liquid, wherein heat that occurs in the region of the guide segment due to friction between the guide segment and the roving guided by the guide segment when the traversing element is operating may be absorbed by the liquid. Because of this, the heat does not accumulate in the region of the guide segment. Instead, it is absorbed by the liquid and may finally be dissipated to a location and discharged into ambient air that is not in immediate contact with the roving.

Various substances may be used for the liquid, such as for instance water or ammonia. In addition, the cavity should be only partially filled with the liquid in order to make it possible for the liquid to evaporate in the region in which the heat is to be dissipated (that is, preferably in the region of the guide segment or other regions of the traversing element that are in contact with the roving.

If the liquid is heated by the heat it has absorbed, it begins to evaporate. Due to the local increase in pressure that occurs inside the cavity, the vapor flows in a direction away from the heat source. As soon as the vapor finally travels into a region of the cavity that is sufficiently spaced apart from the heat source, the vapor condenses and the heat is given off into the ambient air as desired. The liquid that results from the condensation then returns to the region of the heat source (i.e. to the regions of the traversing element that are heated due to friction with the roving) and there may again absorb heat, wherein the return may be due to gravity ("thermosiphon") or due to capillary forces ("heat pipe") (both variants may be implemented in the context of the invention).

Also, the cavity should be formed such that the region in which the liquid evaporates is sufficiently spaced apart from the region in which the evaporated liquid condenses again. The cavity preferably has a length of between 10 cm and 40 cm. In addition, the width (i.e. the transverse extent of the oblong cavity that runs perpendicular to the longitudinal extent) should be between 2 mm and 12 mm. The cavity has in particular a basically cylindrical shape.

It is also advantageous if the support segment is formed as an oblong support arm. The support segment serves primarily for fastening the guide segment, which may have, for instance, a surface that is flat, at least in part, via which it is in contact with the roving. In particular, the support segment serves for mounting the traversing element on a corresponding support member of the spinning machine, wherein the support member may be in the form of a holding element that fixes the traversing element and that, by means of a drive, may be moved back and forth along a guide between two end points (preferably linearly) so that when the spinning machine is operating, the support member and the traversing element perform the desired traversing movement to guide the roving in the aforesaid manner during winding.

It is also extremely advantageous if the cavity is at least partially arranged in the interior of the support arm. For instance, the support arm itself could form the preferably oblong cavity for the liquid. In any case, it is advantageous if at least segments of the cavity containing the liquid extends inside the support arm so that it is not only the guide segment (which is preferably disposed in the region of the end face of the support arm) that may be cooled by the liquid. Rather, with this embodiment of the cavity it is possible for the liquid contained therein also to absorb heat in a region that connects in the longitudinal direction to the guide segment. This is especially advantageous if the support arm of the traversing element during operation is wrapped one or more times by the roving that is suitably guided in order to use friction to apply a certain tensile stress onto the roving before it is wound onto the tube. When the cavity finally extends into the region that is wrapped by the roving, the heat caused by friction between the roving and support arm may also be absorbed in this region by the liquid and thus can be carried away from the roving.

Moreover, it is advantageous if the cavity is at least partially closed off by a guide element having the guide segment so that the guide element forms a portion of the wall delimiting the cavity. In this case, the liquid travels particularly close to the guide segment so that it is possible for the heat to be dissipated in a particularly efficient manner.

It is particularly advantageous if the majority of the cavity, preferably all of the cavity, is enclosed by a pipe wall of a heat pipe, wherein at least part of the heat pipe is arranged in the interior of the support arm and consists of metal, for example. In addition, it is advantageous if at least segments of the preferably elongated heat pipe and the support arm run concentric with one another. In addition, the wall thickness of the pipe wall of the heat pipe and/or that of the wall of the support arm that surrounds the heat pipe should be less than 5 mm, preferably less than 3 mm, in order to enable adequate heat transfer from the outside of the support arm to the liquid. Finally, it is advantageous if a thermally conductive paste is arranged, at least in regions, between the outside of the heat pipe and the inside, facing the latter, of the wall of the support arm surrounding the heat pipe, in order to improve the heat transfer from the pipe wall of the heat pipe to the wall of the support arm.

It is advantageous when the heat pipe is in heat-conducting contact, especially direct contact, with the guide element. Because of this, the heat resulting in the region of the guide element from the contact with the roving that is to be guided may be absorbed particularly efficiently by the liquid and may be dissipated. It is finally also conceivable in this case to fill any intermediate space that is present between the heat pipe and guide element with the thermally conductive paste.

It is also advantageous if the support arm has at least one end-face opening through which the heat pipe extends to the outside of the support arm. In this case, in the region disposed outside of the support arm, the heat pipe may be cooled directly by the ambient air in order to effect the necessary condensation of the liquid evaporated by the heat absorption in the region of the guide element. It is likewise conceivable for the region of the heat pipe located outside of the support arm to be coupled to a cooling element yet to be described in greater detail, in order to further improve cooling of the evaporated liquid in this region.

It is advantageous if the heat pipe is detachably connected to the support arm. The heat pipe, which preferably has an elongated basic shape, may be detachably inserted into the support arm (for instance through the opening in the support arm and from a side facing away from the guide element).

It is likewise advantageous if the traversing element has a cooling element, wherein the cooling element preferably comprises one or a plurality of cooling fins, and wherein the cooling element is connected to the guide segment in a heat conducting manner. The cooling fins may for instance be disc-shaped and be aligned concentric with one another or with a longitudinal axis of the traversing element or its support arm. In particular, the cooling element should be arranged in the region of an end segment of the traversing element that faces away from the guide segment. In this case, the support arm extends between the cooling element and the guide element. If, during operation of the spinning machine having the traversing element, the support arm between cooling element and guide segment is wrapped one or multiple times, as described above, by the roving, this mutual arrangement of the individual segments can result in particularly efficient heat dissipation. In particular, this ensures that the liquid present in the interior of the traversing element cools not only the guide element, but also the region of the support arm wrapped by the roving. The temperature of all of the segments of the traversing element that come into contact with the roving is hereby kept at a relatively low level so that it is possible to prevent a negative effect on the roving properties. Finally, it is also possible to place one or a plurality of cooling elements, in particular one or a plurality of the cooling fins, in the region of the guide element of the traversing element in order to be able to dissipate the heat generated there directly into the ambient air. In this case, the cooling element or elements should preferably be placed in a region facing away from the guide segment. For instance, the cooling elements could project outward in a fin-shaped manner (especially also in a fan-shaped manner) from the back side of the guide element that faces away from the guide element.

It is particularly advantageous if the cooling element surrounds the heat pipe at least partially. In this case, the heat from the interior of the heat pipe may be given off over a particularly large region of the cooling element so that the evaporated liquid may be reliably condensed in order to be able to again absorb heat in the region of the guide segment or in the region of the traversing element that is disposed between the guide segment and the cooling element.

It is particularly advantageous if the cooling element is directly connected to the heat pipe in order to provide good heat transfer between heat pipe and cooling element. For instance, the heat pipe may be placed in the end region of the traversing element that faces away from the guide segment and may thus surround the heat pipe around its circumference and possibly even its end face. In addition to direct contact between heat pipe and cooling element, it may also be advantageous if the conductive paste is applied between the elements (at least in segments) in order to further improve heat transfer.

It is particularly advantageous if the cooling element is fastened to the support arm. To this end, the support arm preferably has a holding segment in its end region facing away from the guide segment, to which holding element the cooling element is attached or to which it is connected in some other manner by means of a positive or non-positive fit.

Finally, the inventive spinning machine comprises at least one spinning nozzle by means of which a roving may be produced from a fiber bundle supplied to the spinning nozzle, and a winding device for winding the roving produced by the spinning nozzle. The spinning machine is preferably an air-jet spinning machine. The basic principle of such spinning machines is that a fiber bundle is guided through a spinning nozzle in which a swirled air flow is generated. The latter finally effects that some of the outer fibers of the supplied fiber bundle are wrapped as so-called wrapping fibers around the centrally running fiber strand, which in turn consists of core fibers running substantially parallel to one another.

In any case, the spinning machine according to the invention is characterized in that the winding device comprises a movably mounted traversing element that, when the spinning machine is operating, guides the roving in a traversing manner while the roving is wound onto a tube by means of the winding device. In addition, the traversing element is embodied according to the preceding and the following description, wherein the described features may be implemented individually or in any desired combination as long as there is no conflict because of this and as long as the traversing element has at least one cavity that is closed to the outside and that is at least partially filled with a liquid, wherein heat that is created in the region of the guide segment by friction between the guide segment and the roving that is guided by the guide segment when the traversing element is operating may be absorbed by the liquid.

It is advantageous if the winding device comprises at least one tube holder for fixing a tube, which tube holder can be set in rotation about a (preferably vertical) rotation axis by means of a drive (e.g. an electric motor), wherein the tube holder may comprise for instance a clamping arrangement that is used to fix the tube in the region of one or both end faces in a clamping manner. In any case, the smallest distance between the cooling element and the aforesaid rotation axis should be a maximum of 40 cm, preferably a maximum of 30 cm, particularly preferably a maximum of 20 cm. By the aforesaid distance (i.e. the distance between the rotation axis and the segment of the cooling element closest to the rotation axis) it is achieved that the air flow, that occurs when the tube loaded with roving is rotated, travels into the region of the cooling element and actively cools the latter. This may cool, and thus condense, the evaporated liquid disposed in the interior of the heat pipe in a particularly rapid manner, so that segments of the traversing element that come into contact with the roving may also be cooled in a particularly efficient manner.

BRIEF DESCRIPTION OF THE DRAWINGS

Further advantages of the invention are described in the following exemplary embodiments, in which.

DETAILED DESCRIPTION

Figure 1:
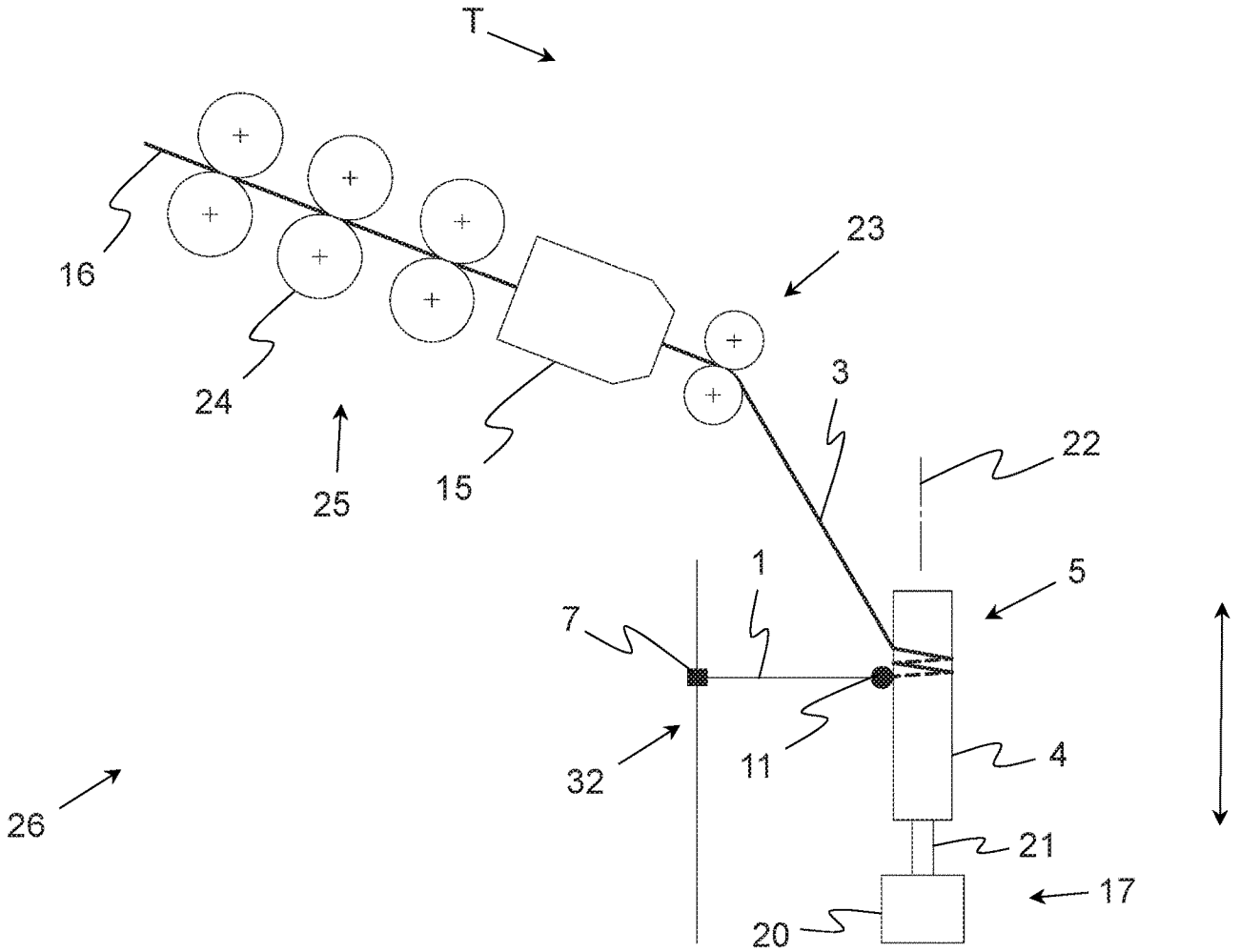
FIG. 1 is a side view of an air-jet spinning machine.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

FIG. 1 is a schematic view of a detail of a spinning machine 26 according to the invention that serves for producing a roving 3.

The depicted spinning machine 26 is embodied as an air-jet spinning machine and preferably comprises a drafting system 25 that has a plurality of corresponding drafting rollers 24 and that is supplied with a fiber bundle 16, for instance in the form of a doubled drafter sliver (for reasons of clarity, only one of the six illustrated drafting rollers 24 is provided with a reference number). In principle, the depicted air-jet spinning machine 26 furthermore comprises a spinning nozzle 15 spaced apart from the drafting system 25 and having an inner vortex chamber, which is known from the prior art and therefore not shown, and in which the fiber bundle 16 or at least a portion of the fibers of the fiber bundle 16 may be provided with a twist by means of a swirled air flow.

Likewise, the spinning machine 26 includes a draw-off unit in the form of a pair of draw-off rollers 23 and a winding device 17 for the roving 3 downstream of the draw-off unit. The winding device 17 comprises a tube holder 21 for fixing a tube 4 and a drive 20 by means of which the tube holder 21 and thus also the correspondingly fixed tube 4 is rotatable about a rotation axis 22 in order to wind roving 3 supplied by the spinning nozzle 15 onto the tube 4.

Furthermore, the winding device 17 comprises a traversing device 32 having a traversing element 1 that may be moved back and forth in the direction of the double arrow illustrated in FIG. 1 by means of a drive (not shown). During the winding process, the traversing element 1 guides the roving 3 in a traversing manner and to this end has a guide element 11 via which it is in contact with the roving 3.

The spinning machine 26 works according to a special air spinning method. For forming the roving 3, the fiber bundle 16 is guided in a transport direction T via an infeed opening into the vortex chamber (not shown and in the interior) of the air spinning nozzle 15. There it receives a twist, i.e. at least a portion of the fibers of the fiber bundle 16 is gripped by an air flow that is generated by appropriately placed air nozzles. A portion of the fibers is thereby pulled at least a little way out of the fiber bundle 16 and is wound around the tip of a yarn forming element which protrudes into the vortex chamber (not shown).

Finally, the fibers of the fiber bundle 16 are drawn out of the vortex chamber via an inlet opening of the yarn forming element and a draw-off channel which is arranged inside the yarn forming element and adjoins the inlet opening. In doing so, the free fiber ends are finally also drawn on a helical trajectory in the direction of the inlet opening and wrap as wrapping fibers around the centrally running core fibers, resulting in a roving 3 which has the desired twist.

Due to the only partial twisting of the fibers, the roving 3 has a (residual) draftability which is essential for the further processing of the roving in a downstream spinning machine 26, for example a ring spinning machine.

Figure 2:
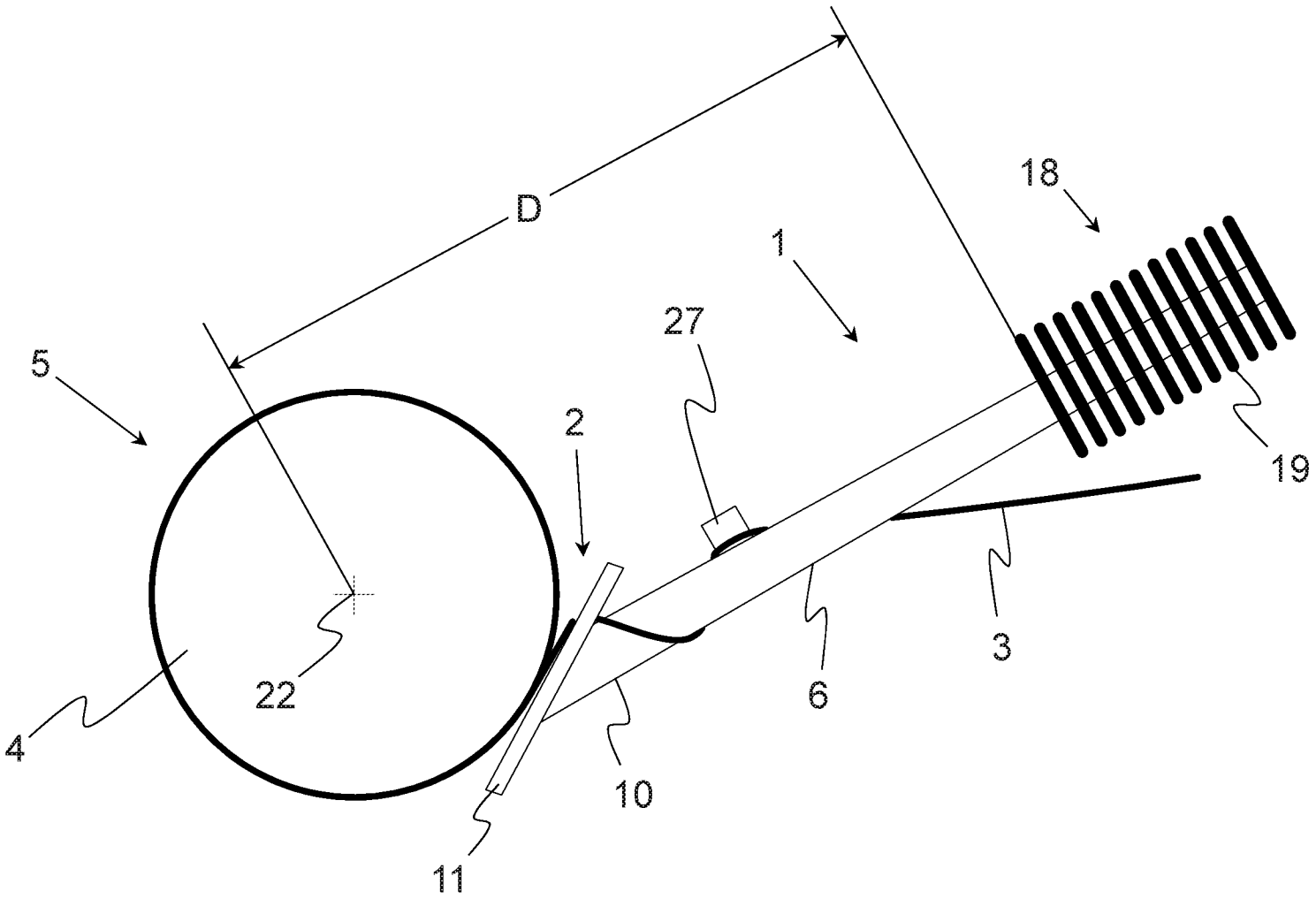
FIG. 2 is a top view of an inventive traversing element.

FIG. 2 now shows a top view of a traversing element 1 according to the invention. The traversing element 1 comprises a guide element 11 having a guide segment 2, wherein the guide segment 2 is in contact with the roving 3 and guides it. At the beginning of the winding process, the guide element 11 rests against the surface of the tube 4 and after a certain winding period it rests against the outermost roving layer of the roving bobbin 5 created by winding.

Figure 3:
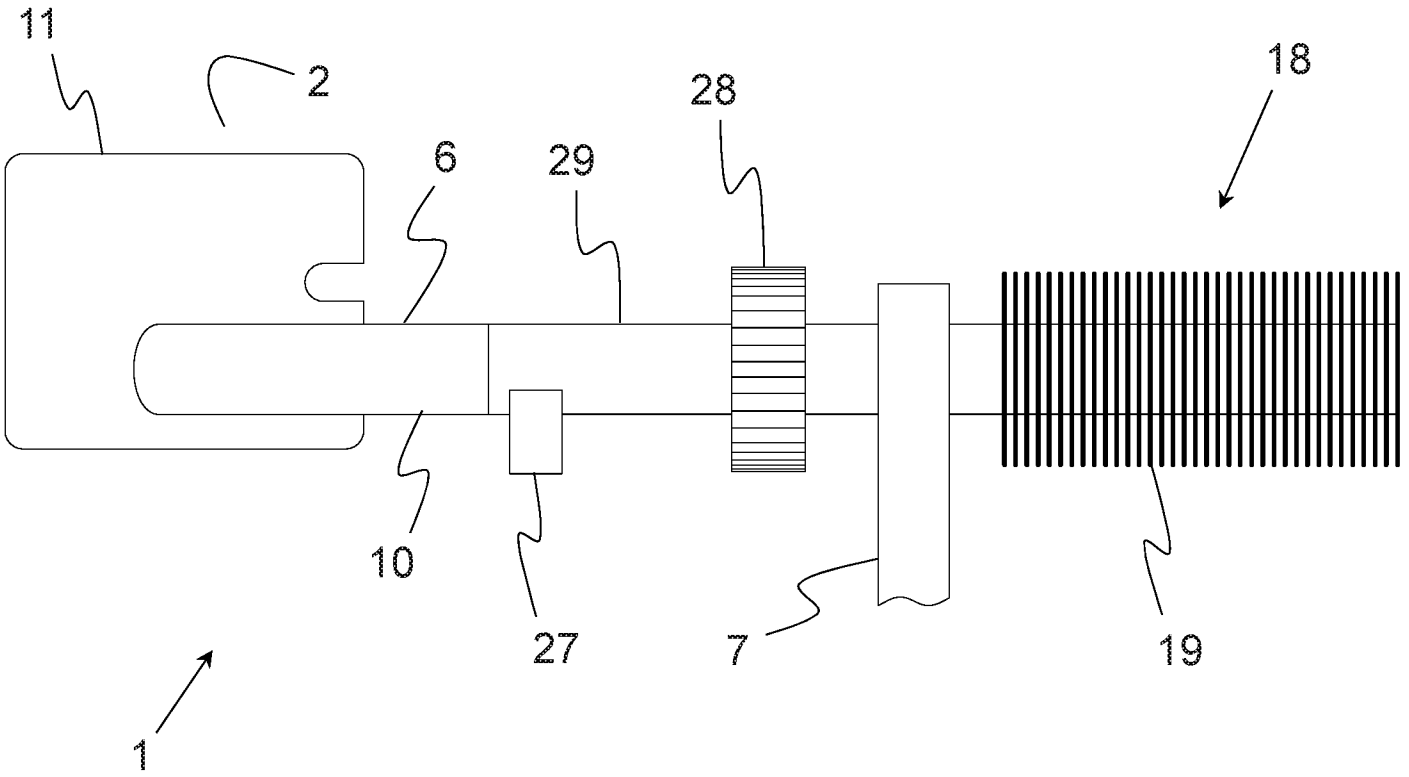
FIG. 3 is a side view of an inventive traversing element.
Figure 4:
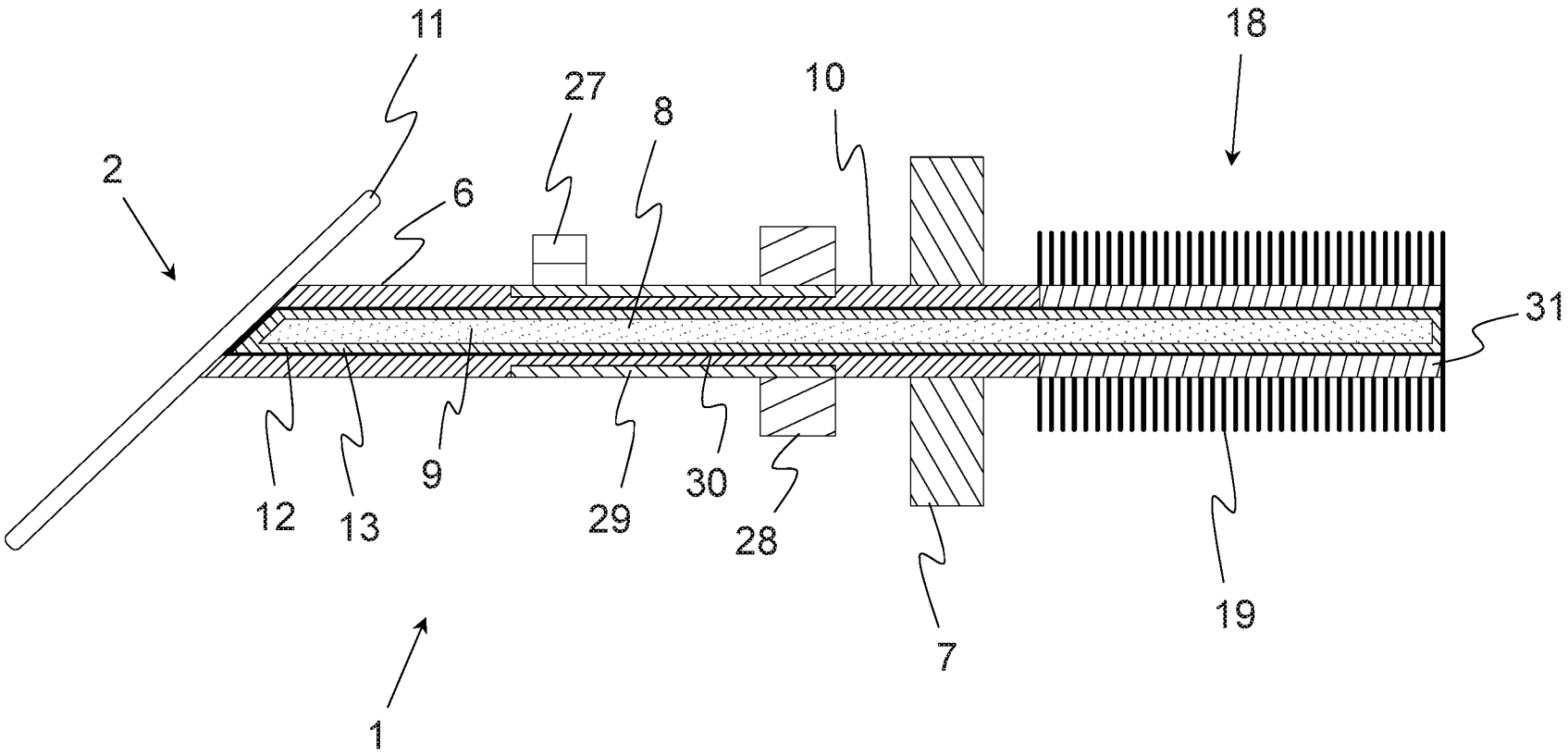
FIG. 4 is a partial cross-section of a top view of the traversing element shown in FIG. 3; and, FIG. 5 is a detail of the depiction shown in FIG. 4.
Figure 5:
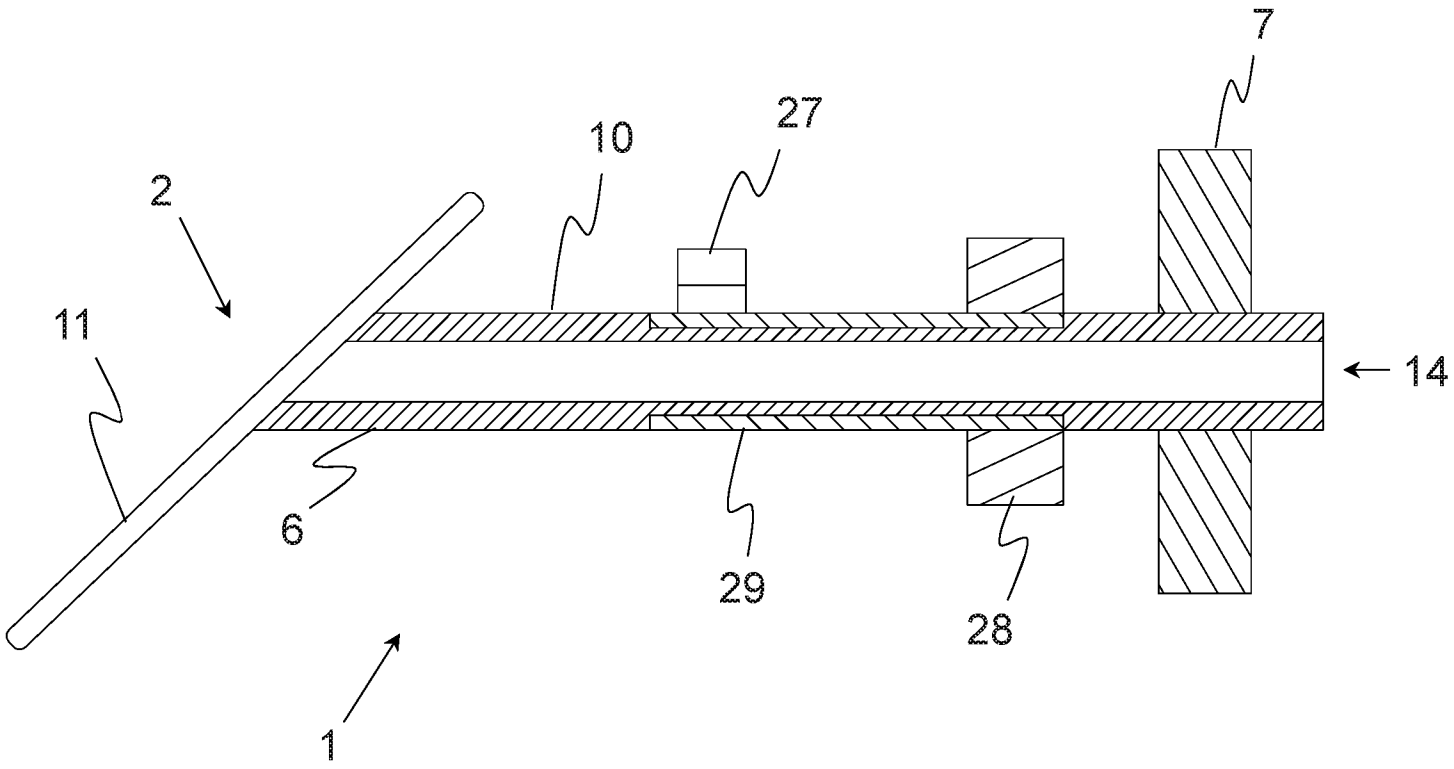

The traversing element 1 furthermore comprises a support segment 6 that is preferably in the form of the shown elongated support arm 10 and to which the guide element 11 is fastened. As illustrated in FIGS. 3 through 5, the support segment 6 serves for fastening to a support member 7 of the spinning machine 26, which support member, in turn, is movable via a drive (not shown) as shown with the transverse movement indicated by the double arrow in FIG. 1.

Moreover, FIG. 2 illustrates that in principle it is advantageous if the roving 3 is in contact with the traversing element 1 not just in the region of the guide segment 2. Instead, as a rule it is desired that the roving 3 wraps around the support segment 6 one or multiple times. The roving is decelerated by the frictional forces that occur so that it may finally be wound onto the tube 4 with a certain tensile stress.

While the roving 3 is now guided by the traversing element 1, the regions of the traversing element 1 that are in contact with the roving 3, i.e., primarily the guide element 11 and the support segment 6 wrapped by the roving 3, heat up due to friction.

According to the invention it is therefore provided that the traversing element 1 comprises, preferably in its interior, a cavity 8 that is partially filled with a liquid 9. As described in greater detail in the following and as illustrated in particular in FIG. 4, the cavity 8 extends from the guide element 11 into the region of a cooling body. As already described in the general description (which is explicitly referenced at this point), the liquid 9 evaporates due to the heating of the guide element 11 and the segment of the support arm 10 wrapped by roving 3. In doing so, the evaporated liquid 9 extracts heat from the aforesaid regions of the traversing element 1 and cools them in return.

In order to be able to give off the heat energy absorbed by the liquid to the ambient air at another location, the cavity 8 is surrounded by a cooling element 18, preferably in an end region of the traversing element 1 facing away (opposite) from the guide segment 2. The cooling element 18, which preferably has a plurality of cooling ribs 19, extracts heat from the evaporated liquid 9 and thus causes the vapor from the liquid to condense. The condensed liquid 9 finally travels back into the region of the guide element 11 and to the region of the support arm 10 wrapped by the roving 3 and there, in turn, cools the aforesaid segments.

FIGS. 3 (side view), 4 (partial cross-sectional top view), and 5 (detail of the view in accordance with FIG. 4) show another embodiment of the traversing element 1 according to the invention.

As may be seen from the aforesaid figures, it is advantageous if the cavity 8 in which the liquid 9 is disposed is formed by a separate heat pipe 13 that is closed on all sides and that, for instance, may be detachably inserted into the support arm 10 via the opening 14 shown in FIG. 5 (in FIG. 4, no visual distinction is made between the liquid 9 and the vapor that results from the liquid absorbing heat; naturally, when the spinning machine 26 is operating, some of the liquid 9 is present as vapor that condenses again in the region of the cooling element 18).

The pipe wall 12 of the heat pipe 13 may rest from the inside either directly against the guide element 11 and/or against the support arm 10. A heat transfer paste 30 that promotes the desired heat transfer is preferably arranged at least in certain sections between the pipe wall 12 and the adjacent segments of the traversing element 1.

Moreover, it may be seen from FIG. 4 that the cooling element 18 preferably comprises a plurality of the cooling ribs 19, which, in turn, are connected to a common cooling ribs support 31. The latter may finally be connected directly to the heat pipe 13 or also to the support arm 10.

Finally, FIGS. 2 through 5 illustrate that the traversing element 1 may have a preferably hook-shaped gripper 27, via the position of which the number of windings of the roving 3 about the support segment 6 can be influenced. To this end, the gripper 27 is preferably mounted via a gripper support 29 that is mounted on the support segment 6 and may be twisted relative thereto. In addition, the gripper support 29 may be connected to or surrounded by a gear wheel 28, which, in turn, may be set into rotation via a corresponding driving gear wheel or a driving gear rack (not shown) in order to change the number of wrappings and thus the braking force acting on the roving 3. Naturally, the gripper support 29 and the gear wheel 28 are not necessarily required; see also FIG. 2.

Finally, with respect to FIG. 2 it should be noted that the cooling element 18 should be disposed in the vicinity of the tube 4. If the smallest distance D, shown in FIG. 2, between the rotation axis 22 of the tube holder 21 and the cooling element 18 is located in the region mentioned in the above description, the air flow generated when the tube 4 is rotated actively cools the cooling element 18 and thus causes particularly efficient condensation of the incoming liquid 9 evaporated in this region in the interior of the traversing element 1.

The present invention is not limited to the exemplary embodiments that have been shown and described. Modifications within the scope of the patent claims are also possible, as is any combination of the described features, even if they are shown and described in different parts of the description or the claims or in different exemplary embodiments.

REFERENCE LIST

1 Traversing element
2 Guide segment
3 Roving
4 Tube
5 Roving bobbin
6 Support segment
7 Support member
8 Cavity
9 Liquid
10 Support arm
11 Guide element
12 Pipe wall
13 Heat pipe
14 Opening
15 Spinning nozzle
16 Fiber bundle
17 Winding device
18 Cooling element
19 Cooling rib
20 Drive
21 Tube holder
22 Rotation axis of the tube holder
23 Pair of draw-off rollers
24 Drafting roller
25 Drafting system
26 Spinning machine
27 Gripper
28 Gear wheel
29 Gripper support
30 Thermally conductive paste
31 Cooling ribs support
32 Traversing device
D Minimum distance between the cooling element and the rotation axis of the tube holder
T Transport direction

The invention claimed is:

1. A traversing element for a spinning machine that produces a roving, the traversing element comprising:

a guide segment disposed to guide the roving onto a surface of a tube or a roving bobbin;

a support segment, the guide segment configured at an end of the support segment and an opposite end of the support segment connectable to a support of the spinning machine, the support segment comprising an elongated support arm;

a closed cavity provided in the traversing element, the closed cavity partially filled with a liquid, wherein heat that occurs in the guide segment due to friction between the guide segment and the roving when the traversing element is operating is absorbed by the liquid;

wherein the cavity is defined at least in part in an interior of the support arm; and wherein the cavity is closed off by a guide element, the guide segment configured on the guide element.

2. A traversing element for a spinning machine that produces a roving, the traversing element comprising:

a guide segment disposed to guide the roving onto a surface of a tube or a roving bobbin;

a support segment, the guide segment configured at an end of the support segment and an opposite end of the support segment connectable to a support of the spinning machine, the support segment comprising an elongated support arm;

a closed cavity provided in the traversing element, the closed cavity partially filled with a liquid, wherein heat that occurs in the guide segment due to friction between the guide segment and the roving when the traversing element is operating is absorbed by the liquid;

wherein the cavity is defined at least in part in an interior of the support arm; and wherein at least a portion of the cavity is enclosed by a pipe wall of a heat pipe, at least part of the heat pipe arranged in the interior of the support arm.

3. The traversing element according to claim 2, wherein the heat pipe is in direct heat-conducting contact with the guide element.

4. The traversing element according to claim 2, wherein the support arm comprises an end-face opening through which the heat pipe extends to outside of the support arm.

5. The traversing element according to claim 2, wherein the heat pipe is detachably connected to the support arm.

6. The traversing element according to claim 1, further comprising a cooling element connected to the guide segment in a heat conducting manner.

7. The traversing element according to claim 2, further comprising a cooling element connected to the guide segment in a heat conducting manner, the cooling element at least partially surrounding the heat pipe.

8. The traversing element according to claim 7, wherein the cooling element is directly connected to the heat pipe.

9. The traversing element according to claim 7, wherein the cooling element is fastened to the support arm.

10. A spinning machine, comprising:

a spinning nozzle that produces a roving from a fiber bundle supplied to the spinning nozzle;

a winding device that winds the roving produced by the spinning nozzle;

the winding device further comprising a movably mounted traversing element that guides the roving in a traversing manner while the roving is wound onto a tube during operation of the spinning machine;

the traversing element further comprising:

a guide segment disposed to guide the roving onto a surface of a tube or a roving bobbin;

a support segment, the guide segment configured at an end of the support segment and an opposite end of the support segment connectable to a support of the spinning machine; and a closed cavity defined in the traversing element, the closed cavity partially filled with a liquid, wherein heat that occurs in the guide segment due to friction between the guide segment and the roving when the traversing element is operating is absorbed by the liquid.

11. The spinning machine according to claim 10, wherein the traversing element further comprises a cooling element connected to the guide segment in a heat conducting manner, and the winding device further comprising at least one tube holder that is set into rotational movement about a rotation axis by a drive, and wherein a distance between the cooling element and the rotation axis is a maximum of 40 cm.

* * * * *